US011380238B2

(12) United States Patent
Chen et al.

(10) Patent No.: US 11,380,238 B2
(45) Date of Patent: Jul. 5, 2022

(54) METHOD FOR DETERMINING GRAY SCALE VALUES OF PIXELS, DISPLAY PANEL AND COMPUTER READABLE STORAGE MEDIUM

(71) Applicant: HKC CORPORATION LIMITED, Guangdong (CN)

(72) Inventors: Wei Chen, Guangdong (CN); Haijiang Yuan, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/190,608

(22) Filed: Mar. 3, 2021

(65) Prior Publication Data

US 2022/0036792 A1 Feb. 3, 2022

(30) Foreign Application Priority Data

Jul. 28, 2020 (CN) ..... 202010743096.6

(51) Int. Cl.
*G09G 3/20* (2006.01)

(52) U.S. Cl.
CPC ... *G09G 3/2003* (2013.01); *G09G 2320/0285* (2013.01)

(58) Field of Classification Search
CPC ..... G09G 3/2003; G09G 2320/0285
See application file for complete search history.

(56) References Cited

FOREIGN PATENT DOCUMENTS

| | | | | |
|---|---|---|---|---|
| CN | 105304048 | A | | 2/2016 |
| CN | 105321486 | A | | 2/2016 |
| CN | 105448225 | A | | 3/2016 |
| CN | 107610665 | A | | 1/2018 |
| CN | 107978291 | A | | 5/2018 |
| CN | 108320723 | A | | 7/2018 |
| CN | 109036260 | A | * | 12/2018 |
| CN | 109036260 | A | | 12/2018 |
| CN | 109147668 | A | | 1/2019 |
| CN | 109285506 | A | * | 1/2019 |
| CN | 109285506 | A | | 1/2019 |

(Continued)

OTHER PUBLICATIONS

Chinese Office Action, dated Feb. 18, 2021, for Hui ke co., ltd., Chinese Application No. 202010743096.6, filed Jul. 28, 2020.

(Continued)

*Primary Examiner* — Kenneth B Lee, Jr.
(74) *Attorney, Agent, or Firm* — Law Offices of Albert Wai-Kit Chan, PLLC

(57) ABSTRACT

A method for determining gray scale values of pixels is provided, which includes the following operations: determining gray scale values of pixels to be displayed of a current display picture and a picture type of the current display picture; determining a target refresh rate according to the picture type; determining a target gray scale correction value according to the target refresh rate, and determining target gray scale values according to the target gray scale correction value and the gray scale values, the target refresh rate and the target gray scale correction value are negatively correlated. A display panel and a computer readable storage medium are also provided. The present disclosure slows down the color unevenness of the display panel.

20 Claims, 3 Drawing Sheets

(56) References Cited

FOREIGN PATENT DOCUMENTS

| | | | | |
|---|---|---|---|---|
| CN | 109587468 | A | | 4/2019 |
| CN | 110085157 | A | | 8/2019 |
| CN | 110164356 | A | * | 8/2019 |
| CN | 110164356 | A | | 8/2019 |

OTHER PUBLICATIONS

Chinese Office Action, dated May 10, 2021, for Hui ke co., ltd., Chinese Application No. 202010743096.6, filed Jul. 28, 2020.

* cited by examiner

METHOD FOR DETERMINING GRAY SCALE VALUES OF PIXELS, DISPLAY PANEL AND COMPUTER READABLE STORAGE MEDIUM

CROSS-REFERENCE TO RELATED APPLICATIONS

The present disclosure claims the benefit of a Chinese patent application no. 202010743096.6, filed on Jul. 28, 2020, entitled "Method for Determining Gray Scale Values of Pixels, Display Panel and Computer Readable Storage Medium", the entire content of which is incorporated herein for reference.

TECHNICAL FIELD

The present disclosure relates to the technical field of display equipments, in particular to a method for determining gray scale values of pixels, a display panel and a computer readable storage medium.

BACKGROUND

The statements herein only provide background information related to this disclosure and does not necessarily constitute prior art.

In the manufacture of display panels, for being limited by the crystallization process, TFTs (Thin Film Transistors) fabricated on large-area substrate has non-uniformity in electrical parameters, and the non-uniformity will be converted into brightness differences of the display panel, thus causing color uneven phenomenon of the display panel.

The refresh rate refers to the number of times the electron beam repeatedly scans a picture on the screen. The higher the refresh rate, the less the charging time of the thin film transistors, which will make the color uneven phenomenon of the display panel more obvious.

SUMMARY

The main objective of the present disclosure is to provide a method for determining gray scale values of pixels, a display panel and a computer readable storage medium, aiming to solve the problem that display panels have obvious color unevenness.

In order to achieve the above objective, the present disclosure provides a method for determining gray scale values of pixels, which includes the following operations:

determining gray scale values of pixels to be displayed of the current display picture and a picture type of the current display picture;

determining a target refresh rate according to the picture type; and determining a target gray scale correction value according to the target refresh rate, and determining target gray scale values according to the target gray scale correction value and the gray scale values, the target refresh rate and the target gray scale correction value being negatively correlated.

In one embodiment, the operation of determining a target gray scale correction value according to the target refresh rate includes:

determining a gray scale correction value of the pixels to be displayed, and determining a compensation parameter according to the target refresh rate; and correcting the gray scale correction value according to the compensation parameter to obtain the target gray scale correction value.

In one embodiment, the operation of determining gray scale correction values of pixels to be displayed includes:

determining corresponding display positions of the pixels to be displayed on the display panel; and determining the gray scale correction value of the pixels to be displayed according to the display positions.

In an embodiment, the operation of determining a gray scale correction value of the pixels to be displayed according to the display positions includes:

determining a lookup table about display positions and gray scale correction values;

determining the gray scale correction value corresponding to the display positions in the lookup table.

In one embodiment, after the operation of determining gray scale values of pixels to be displayed of a current display picture, the operation further includes:

determining display positions of the pixels to be displayed on the display panel;

in responding to that the display positions are in a color uneven area of the display panel, performing the operation of determining a picture type of the current display picture;

in responding to that the display positions are not in the color uneven area of the display panel, taking the gray scale values as the target gray scale values.

In an embodiment, the picture type includes a moving picture and a still picture, and the operation of determining a target refresh rate according to the picture type includes:

obtaining a preset refresh rate;

in responding to that the current display picture is a dynamic picture according to the picture type, increasing the preset refresh rate to obtain the target refresh rate; and in responding to that the current display picture is a static picture according to the picture type, decreasing the preset refresh rate to obtain the target refresh rate.

In one embodiment, the operation of determining a picture type of the current display picture includes:

obtaining a previous display picture frame;

determining a second pixel of the previous display picture frame corresponding to a first pixel of the current display picture, and comparing a pixel value of the first pixel with a pixel value of the second pixel;

determining that the current display picture is a static picture when a number of first pixels whose pixel values are same as pixel values of corresponding second pixels is greater than a first preset number; and determining that the current display picture is a dynamic picture when a number of first pixels whose pixel values are different from pixel values of corresponding second pixels is greater than a second preset number.

In one embodiment, after the operation of determining a target gray scale correction value according to the target refresh rate and determining target gray scale values according to the target gray scale correction value and the gray scale values, the method further includes:

determining a display time point of a next display picture frame according to the target refresh rate after all pixels to be displayed of the current display picture are displayed on the display panel according to their corresponding target gray scale values;

in responding to that the display time point arrives, taking the next display picture frame as the current display picture, and repeat to perform the operation of determining gray scale values of pixels to be displayed of the current display picture and a picture type of the current display picture.

To achieve the above objective, the present disclosure also provides a display panel including a memory and at least one processor. The memory stores computer-executable instructions executable by the at least one processor, when the computer-executable instructions are executed by the at least one processor, the computer-executable instructions cause the at least one one processor to perform the following operations:

determining gray scale values of pixels to be displayed of the current display picture and a picture type of the current display picture;

determining a target refresh rate according to the picture type; and determining a target gray scale correction value according to the target refresh rate, and determining target gray scale values according to the target gray scale correction value and the gray scale values, the target refresh rate and the target gray scale correction value being negatively correlated.

To achieve the above objective, the present disclosure further provides a computer readable storage medium storing computer executable instructions executable by at least one processor, when the computer-executable instructions are executed by the at least one processor, the computer-executable instructions cause the at least one processor to perform the following operations:

determining gray scale values of pixels to be displayed of the current display picture and a picture type of the current display picture;

determining a target refresh rate according to the picture type; and determining a target gray scale correction value according to the target refresh rate, and determining target gray scale values according to the target gray scale correction value and the gray scale values, the target refresh rate and the target gray scale correction value being negatively correlated.

In the method for determining gray scale values of pixels, the display panel and the computer readable storage medium, the display panel determines gray scale values of pixels to be displayed of a current display picture and a picture type of the current display picture, determines s target refresh rate according to the picture type, so as to determine a target gray scale correction value according to the target refresh rate, and correct the gray scale values according to the target gray scale correction value to obtain target gray scale values. Since the display panel can adjust the refresh rate according to the picture type of the current display picture, the gray scale correction value is determined according to the adjusted refresh rate to compensate the gray scale values of the pixels to be displayed, thereby lightening the color uneven phenomenon of the display panel.

The realization of purpose, functional features and advantages of the present disclosure will be further explained in connection with embodiments and with reference to the accompanying drawings.

DETAILED DESCRIPTION OF THE EMBODIMENTS

It should be understood that the specific embodiments described herein are intended to explain the disclosure only and are not intended to limit the disclosure.

A solution of an embodiment of the present disclosure is to determine gray scale values of pixels to be displayed of a current display picture and a picture type of the current display picture; determine a target refresh rate according to the picture type; determine a target gray scale correction value according to the target refresh rate, and determine target gray scale values according to the target gray scale correction value and the gray scale values, the target refresh rate and the target gray scale correction value are negatively correlated.

Since the display panel can adjust a refresh rate according to the picture type of the current display picture, the gray scale correction value is determined according to the adjusted refresh rate to compensate the gray scale values of the pixels to be displayed, thus lightening the color uneven phenomenon of the display panel.

Figure 1:
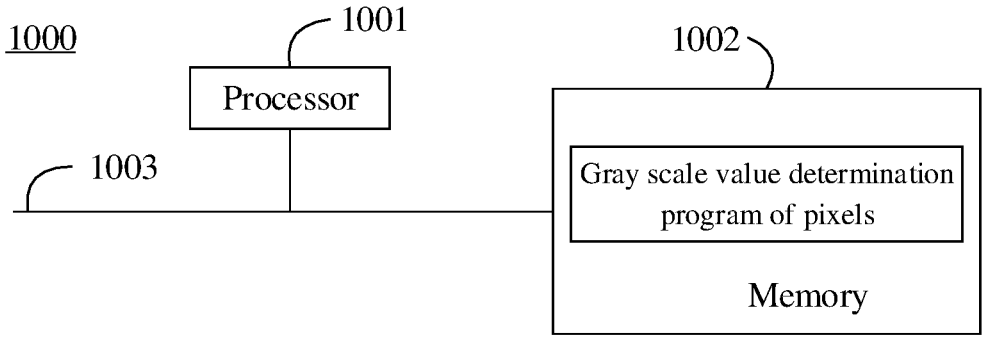
FIG. 1 is a schematic diagram of a hardware structure of a display panel according to an embodiment of the present disclosure.

As one implementation manner, the display panel can be shown in FIG. 1.

The embodiments of the present disclosure relate to a display panel 1000, which includes a processor 1001 such as a CPU, a memory 1002, and a communication bus 1003. The communication bus 1003 is configured to enable connection and communication between those components.

The memory 1002 may be a high-speed RAM memory (Random Access Memory) or a stable memory (non-volatile memory), such as a magnetic disk memory. As shown in FIG. 1, as a computer storage medium, the memory 1002 may include a gray scale value determination program of pixels. The processor 1001 may be configured to invoke the gray scale value determination program of pixels in the memory 1002 and perform the following operations:

determining gray scale values of pixels to be displayed of a current display picture and a picture type of the current display picture;

determining a target refresh rate according to the picture type; and determining a target gray scale correction value according to the target refresh rate, and determining target gray scale values according to the target gray scale correction value and the gray scale values, the target refresh rate and the target gray scale correction value being negatively correlated.

In one embodiment, the processor 1001 may be configured to invoke the gray scale value determination program of pixels stored in the memory 1002 and perform the following operations:

determining a gray scale correction value of the pixels to be displayed, and determining a compensation parameter according to the target refresh rate; and correcting the gray scale correction value according to the compensation parameter to obtain the target gray scale correction value.

In one embodiment, the processor 1001 may be configured to invoke the gray scale value determination program of pixels stored in the memory 1002 and perform the following operations:

determining corresponding display positions of the pixels to be displayed on the display panel 1000;

determining the gray scale correction value of the pixels to be displayed according to the display positions.

In one embodiment, the processor 1001 may be configured to invoke the gray scale value determination program of pixels stored in the memory 1002 and perform the following operations:

determining a lookup table about display positions and gray scale correction values;

determining the gray scale correction value corresponding to the display positions according to the lookup table.

In one embodiment, the processor 1001 may be configured to invoke the gray scale value determination program of pixels stored in the memory 1002 and perform the following operations:

determining display positions of the pixels to be displayed on the display panel 1000;

in responding to that the display positions are in a color uneven area of the display panel 1000, performing the operation of determining a picture type of the current display picture;

in responding to that the display positions are not in the color uneven area of the display panel 1000, taking the gray scale values as the target gray scale values.

In one embodiment, the processor 1001 may be configured to invoke the gray scale value determination program of pixels stored in the memory 1002 and perform the following operations:

obtaining a preset refresh rate;

in responding to that the current display picture is a dynamic picture according to the picture type, increasing the preset refresh rate to obtain the target refresh rate; and in responding to that the current display picture is a static picture according to the picture type, decreasing the preset refresh rate to obtain the target refresh rate.

In one embodiment, the processor 1001 may be configured to invoke the gray scale value determination program of pixels stored in the memory 1002 and perform the following operations:

obtaining a previous display picture frame;

determining a second pixel of the previous display picture frame corresponding to a first pixel of the current display picture, and comparing a pixel value of the first pixel with a pixel value of the second pixel;

determining that the current display picture is a static picture when a number of first pixels whose pixel values are same as pixel values of corresponding second pixels is greater than a first preset number; and determining that the current display picture is a dynamic picture when a number of first pixels whose pixel values are different from pixel values of corresponding second pixels is greater than a second preset number.

In one embodiment, the processor 1001 may be configured to invoke the gray scale value determination program of pixels stored in the memory 1002 and perform the following operations:

determining a display time point of a next display picture frame according to the target refresh rate after all pixels to be displayed of the current display picture are displayed on the display panel 1000 according to their corresponding target gray scale values;

in responding to that the display time point arrives, taking the next display picture frame as the current display picture, and repeat to perform the operation of determining gray scale values of pixels to be displayed of the current display picture and a picture type of the current display picture.

In the present embodiment, the display panel 1000 determines gray scale values of pixels to be displayed of a current display picture and a picture type of the current display picture, determines a target refresh rate according to the picture type, so as to determine a target gray scale correction value according to the target refresh rate to correct the gray scale values to obtain target gray scale values. Since the display panel 1000 can adjust the refresh rate according to the picture type of the current display picture, the gray scale correction value is determined according to the adjusted refresh rate to compensate the gray scale values of the pixels to be displayed, the color uneven phenomenon of the display panel 1000 is lightened.

Based on the above hardware architecture, an embodiment of a method for determining gray scale values of pixels of the present disclosure is provided.

Figure 2:
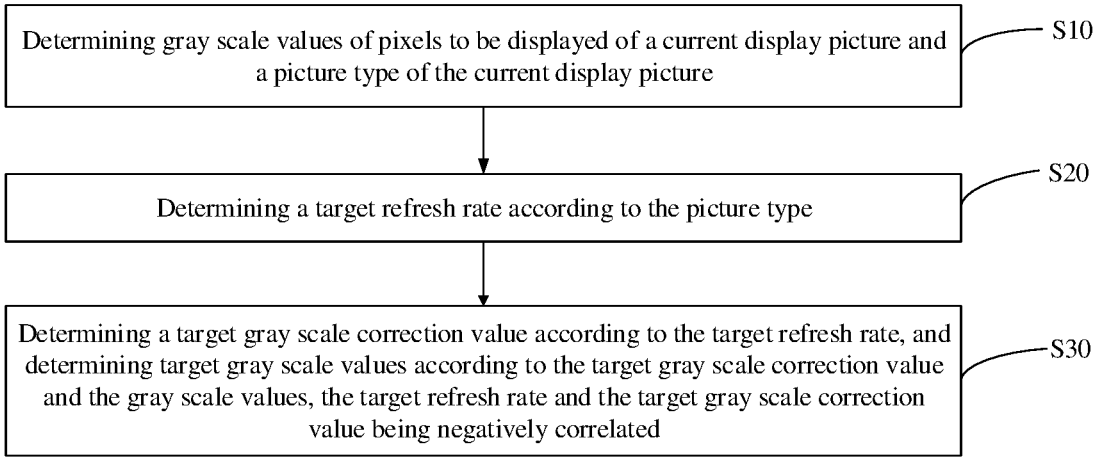
FIG. 2 is a flow diagram of an embodiment of a method for determining gray scale values of pixels of the present disclosure.

Referring to FIG. 2, FIG. 2 is an embodiment of determining gray scale values of pixels according to the present disclosure. The method includes the following operations:

Operation S10, determining gray scale values of pixels to be displayed of a current display picture and a picture type of the current display picture.

In the present embodiment, the execution body of the method is a display panel. After receiving an image signal, the display panel analyzes the image signal to obtain the current display picture, and the current display picture is a picture to be displayed. The current display picture includes a plurality of pixels. Each pixel has a corresponding gray scale value. Since there are many pixels in the current display picture, the pixel value of each pixel obtained by analyzing the image signal is compressed data. The display panel needs to further decompress the analyzed data to obtain the pixel value corresponding to each pixel, and then convert the pixel value into a gray scale value.

Figure 3:
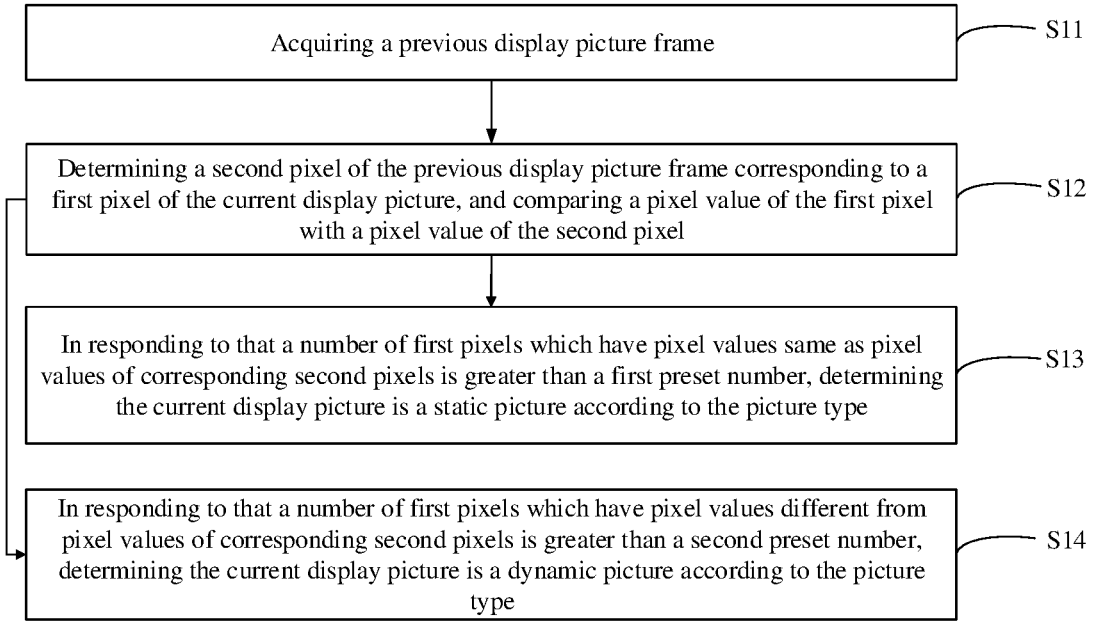
FIG. 3 is a detailed flow diagram of determining a picture type of a current display picture of operation S10 of FIG. 2.

Display pictures are divided into a variety of picture types, which include dynamic pictures and static pictures. The display panel is provided with a DDR (Double Data Rate Synchronous Dynamic Random Access memory) for storing gray scale values of pixels of a previous display picture frame. The display panel can determine a picture type of the current display picture by comparing the current display picture with the previous display picture frame. Specifically, please refer to FIG. 3, the operation of determining a picture type of the current display picture in operation S10 includes:

Operation S11, acquiring a previous display picture frame;

Operation S12, determining a second pixel of the previous display picture frame corresponding to a first pixel of the current display picture, and comparing a pixel value of the first pixel with a pixel value of the second pixel;

Operation S13, in responding to that a number of first pixels which have pixel values same as pixel values of corresponding second pixels is greater than a first preset number, determining the current display picture is a static picture according to the picture type;

operation S14, in responding to that a number of first pixels which have pixel values different from pixel values of corresponding second pixels is greater than a second preset number, determining the current display picture is a dynamic picture according to the picture type.

The display panel obtains a pixel value of each pixel of the previous display picture frame from the DDR, and defines each pixel of the previous display picture frame as a second pixel, and each pixel of the current display picture as a first pixel. The display panel further determines the second pixels corresponding to the first pixels one by one. Each first pixel and the second pixel corresponding to the first pixel have a same display position on the display panel. The display panel further compares the pixel values of the first pixels with the pixel values of the second pixels, and if the pixel value of each first pixel is the same as the pixel value of the second pixel corresponding to the first pixel, it indicates that the current display picture and the previous display picture frame are the same, and the current display picture is determined to be a static picture according to the picture type. If the current display picture contains one or more first pixel(s) whose pixel value(s) is(are) different from the pixel value(s) of the second pixel(s) corresponding to the first pixel(s), it indicates that the current display picture changes as compared to the previous display picture frame, and the current display picture is a dynamic picture according to the picture type.

In addition, the display panel can also determine the number of first pixels whose pixel values are same as pixel values of the second pixels corresponding to the first pixels. If the number is greater than a first preset number, it can be determined that the current display picture only changes in a small range as compared with the previous display picture frame, i.e., the current display picture is also defined as a static picture according to the picture type. The first preset number can be determined according to a total number of pixels and a proportion threshold. If the number is less than or equal to the first preset number, it can be determined that the current display picture has changed in a large range as compared with the previous display picture frame, i.e., the current display picture is defined as a dynamic picture according to the picture type.

Of course, the display panel can also determine a number of first pixels whose pixel values are different from the pixel values of the second pixels corresponding to the first pixels, If the number is greater than a second preset number, it can be determined that the current display picture has changed in a large range as compared with the previous display picture frame, i.e., the current display picture is defined as a dynamic picture according to the picture type. The second preset number can be determined according to the total number of pixels and a proportion threshold. If the number is less than or equal to the second preset number, it can be determined that the current display picture has changed in a small range as compared with the previous display picture frame, i.e., the current display picture is also defined as a static picture according to the picture type.

Operation S20, determining a target refresh rate according to the picture type.

The display panel can store a mapping relationship between picture types and refresh rates. The picture types include but are not limited to a dynamic picture and a static picture. The display panel can determine a refresh rate according to the mapping relationship and the picture type, and the refresh rate is the target refresh rate.

The display panel playing pictures according to a corresponding frame rate, for example, the frame rate being 200 indicates that the display panel can play 200 frames of pictures theoretically in one second. The refresh rate refers to the number of times electron beams repeatedly scan pictures on a screen. The refresh rate is the number of pictures actually played by the display panel in one second. The refresh rate is generally 60 Hz, i.e. the display panel actually plays 60 pictures in one second. It can be understood that, in general, the display panel selects 60 of the 200 pictures for display. In this embodiment, the refresh rate of a dynamic picture is higher than that of a static picture, the reason is that, the characters and scenes in the dynamic picture have changed greatly, if the refresh rate is low, for example, the refresh rate is 50 Hz, it indicates that four picture frames are not displayed on the display panel between a previous picture frame displayed immediately before a currently displayed picture frame and the currently displayed picture frame, thus causing incoherent movements of the people displayed on the display panel and even dragging phenomenon. Therefore, it is necessary to improve the refresh rate. However, when the current display picture is a static picture, the change of characters or scenes is small or even unchanged, so the refresh rate is small and there will be no dynamic incoherence or dragging of characters. At this time, the refresh rate can be appropriately reduced.

Operation S30, determining a target gray scale correction value according to the target refresh rate, and determining target gray scale values according to the target gray scale correction value and the gray scale values, the target refresh rate and the target gray scale correction value being negatively correlated.

In this embodiment, when the display panel is manufactured, due to the limitation of the process, the TFT has non-uniformity in electrical parameters, the non-uniformity will be converted into brightness differences on the display panel, thus causing color unevenness of the display panel. Therefore, it is necessary to compensate the phenomenon of color unevenness to lighten the phenomenon of color unevenness. However, the refresh rate will affect the severity of color unevenness. Specifically, when the refresh rate is high, the pixel charging time is short, resulting in the brightness of the displayed pixels being darker. When the light is weak, the human eye is more likely to sense the color unevenness of the display panel, that is, when the refresh rate is high, the color unevenness is more serious, while when the refresh rate is low, the color unevenness is not obvious. The color uneven phenomenon can be alleviated by compensating the gray scale values of the pixels to reduce the difference between the brightness of the pixels and the brightness around.

In this regard, firstly, a color uneven area where the color uneven phenomenon occurs on each display panel is determined, and a mapping relationship between refresh rates and gray scale correction values of pixels whose display positions are located in the color uneven area is tested, and the mapping relationship is stored. Of course, the gray scale correction value of pixels whose display positions is not located in the color uneven area is zero. After the display panel determines a gray scale value of a pixel, the gray scale correction value can be determined according to the target refresh rate and the display position of the pixel, and then the gray scale value of the pixel is compensated according to the gray scale correction value to obtain a target gray scale value of the pixel. After the target gray scale value is determined, an overdrive voltage corresponding to the target gray scale value can be applied to liquid crystal molecules corresponding to the pixel to display a pixel picture corresponding to the pixel on the display panel. After the last pixel to be displayed of the current display picture is displayed, the display of the next display picture frame needs to be performed. Since the refresh rate of the display panel changes in real time, the display panel needs to determine the display time point of the next display picture frame according to the target refresh rate, and can receive the next display picture frame when the display time point arrives. At this time, the next display picture frame is taken as the current display picture, and operations S10-S30 is repeated.

It should be noted that the target refresh rate has a negative correlation with the target gray scale correction value, that is, the higher the target refresh rate, the smaller the gray scale correction value.

In the technical scheme of this embodiment, the display panel determines the gray scale values of the pixels to be displayed of the current display picture and the picture type of the current display picture, and then determines the target refresh rate according to the picture type, so as to determine the target gray scale correction value according to the target refresh rate to correct the gray scale value to obtain the target gray scale value. Since the display panel can adjust the refresh rate according to the picture type of the current display picture, the gray scale correction value is determined according to the adjusted refresh rate to compensate the gray scale value of the pixels to be displayed, and the color uneven phenomenon of the display panel is lightened.

Figure 4:
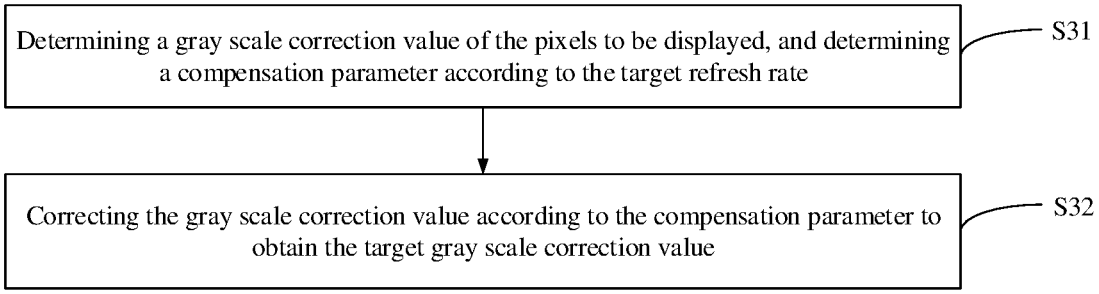
FIG. 4 is a detailed flow diagram of determining a target gray scale correction value according to a target refresh rate of operation 30 of FIG. 2.

Referring to FIG. 4, FIG. 4 is a schematic diagram of a detailed flow for determining a target gray scale correction value according to the target refresh rate in operation S30 of FIG. 2, which includes:

Operation S31, determining a gray scale correction value of the pixels to be displayed, and determining a compensation parameter according to the target refresh rate;

Operation S32, correcting the gray scale correction value according to the compensation parameter to obtain the target gray scale correction value.

In this embodiment, the display panel stores a lookup table of display positions of pixels and gray scale correction values, and the display panel can search the lookup table to obtain the gray scale correction value corresponding to the pixels according to the display positions of the pixels to be displayed on the display panel. The establishment of lookup table is based on testing the display panel under the preset refresh rate. Therefore, the display panel needs to correct the gray scale correction value according to the target refresh rate and the preset refresh rate to obtain the target gray scale correction value.

Specifically, the display panel can determine the compensation parameter according to the target refresh rate, and the compensation parameter can be an incremental value, a decremental value or a correction coefficient. The compensation parameter can be determined according to values of the target refresh rate and the preset refresh rate. When the target refresh rate is greater than the preset refresh rate, the compensation parameter can be an incremental value or the correction coefficient be greater than 1. When the target refresh rate is less than the preset refresh rate, the compensation parameter is a decremental value or the correction coefficient be less than 1.

The display panel superimposes the gray scale correction value with the incremental value or the decremental value to obtain the target gray scale correction value, or the display panel multiplies the gray scale correction value by the correction coefficient to obtain the target gray scale value.

It should be noted that the target refresh rate and the correction parameter are positively correlated, and the larger the difference between the target refresh rate and the preset refresh rate, the larger the compensation parameter.

In the technical scheme provided by this embodiment, the display panel determines the compensation parameter according to the target refresh rate, thereby correcting the gray scale correction value according to the compensation parameter to obtain the target gray scale correction value.

Figure 5:
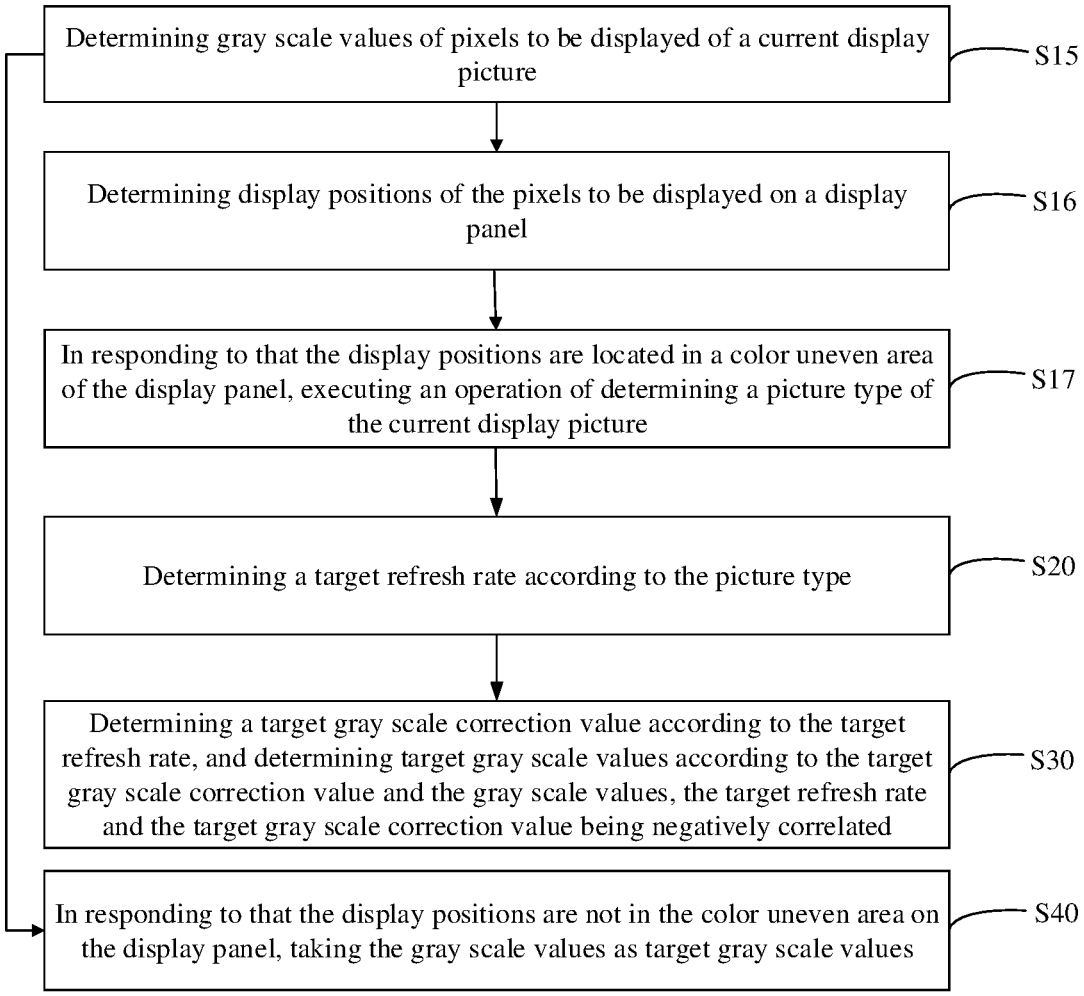
FIG. 5 is a flow diagram of another embodiment of the method for determining gray scale values of pixels of the present disclosure.

Referring to FIG. 5, FIG. 5 is another embodiment of the method for determining gray scale values of pixels of the present disclosure, the method further includes:

Operation S15, determining gray scale values of pixels to be displayed of a current display picture.

Operation S16, determining display positions of the pixels to be displayed on a display panel;

Operation S17, in responding to that the display positions are located in a color uneven area of the display panel, executing an operation of determining a picture type of the current display picture; and Operation S40, in responding to that the display positions are not in the color uneven area on the display panel, taking the gray scale values as target gray scale values.

In this embodiment, the display panel has a color uneven area, that is, the display panel does not need to compensate the gray scale value of each pixel, but only needs to compensate the gray scale values of pixels corresponding to display positions in the color uneven area.

As such, the display panel determines the gray scale values of the pixels to be displayed and the display positions of the pixels to be displayed on the display panel, and judge whether the display positions are in the color uneven area. If the display positions are in the color uneven area, the gray scale values of the pixels needs to be compensated, that is, the display panel determines the picture type of the current display picture, and executes operations S20 and S30. When the display positions are not in the color uneven area, there is no need to compensate the gray scale values of the pixels, at this time, the gray scale values can be taken as the target gray scale values.

In the technical scheme provided by this embodiment, the display panel determines display positions of pixels to be displayed on the display panel so as to judge whether the display positions are in a color uneven area. If the display positions are in the color uneven area, gray scale values of the pixels to be displayed is compensated, so that the display panel does not need to compensate the gray scale value of each pixel of the display picture.

Figure 6:
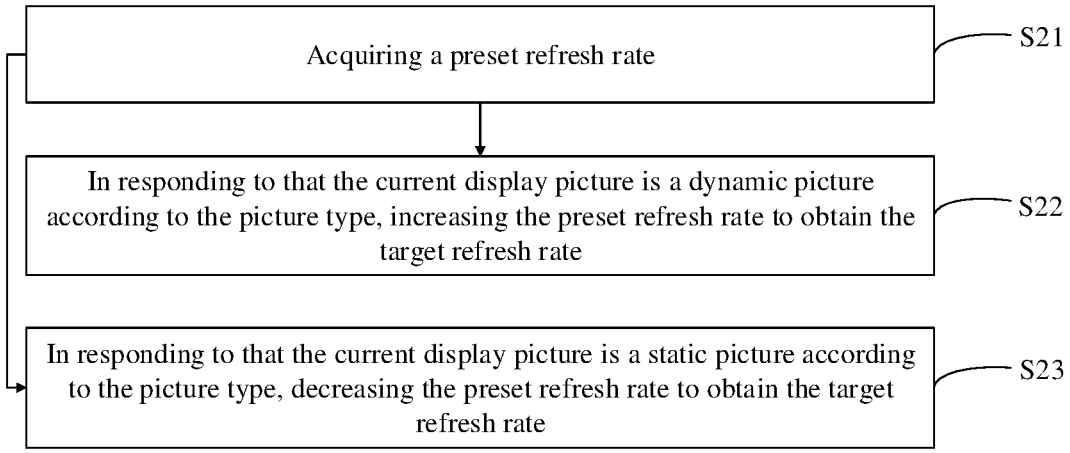
FIG. 6 is a detailed flow diagram of operation S20 of FIG. 2.

Referring to FIG. 6, FIG. 6 is a detailed flow diagram of operation S20 in FIG. 2, that is, operation S20 includes:

Operation S21, acquiring a preset refresh rate;

Operation S22, in responding to that the current display picture is a dynamic picture according to the picture type, increasing the preset refresh rate to obtain the target refresh rate; and Operation S23, in responding to that the current display picture is a static picture according to the picture type, decreasing the preset refresh rate to obtain the target refresh rate.

In this embodiment, the display panel is provided with a preset refresh rate. After determining a picture type of the current display picture, the display panel can correct the preset refresh rate according to the picture type to obtain the target refresh rate. Specifically, when the current display picture is a static picture according to the picture type, the preset refresh rate is decreased to obtain the target refresh rate. However, when the current display picture is a dynamic picture, the preset refresh rate is increased to obtain the target refresh rate, that is, the refresh rate corresponding to a dynamic picture is greater than the refresh rate corresponding to a static picture, and the principle that the refresh rate corresponding to the dynamic picture is greater than the refresh rate corresponding to the static picture has been explained above and will not be repeated here.

In the technical scheme provided by this embodiment, the display panel determines a preset refresh rate, decreases the preset refresh rate when the current display picture is a static picture according to the picture type, and increases the preset refresh rate when the current display picture is a dynamic picture according to the picture type, and the display panel reasonably adjusts the refresh rate according to the picture type of the current display picture.

In one embodiment, when the current display picture is a static picture, a decreasing amount of the preset refresh rate can be determined according to the number of pixels of the current display picture that have changed, and the changed pixels here refer to pixels of the current display picture different from corresponding pixels of the previous display picture frame. Specifically, the display panel calculates a number of first pixels whose pixel values different from those of second pixels values corresponding to the first pixels. A first proportion is obtained by dividing the total number of pixels of the current display picture by the number of the first pixels whose pixel values different from those of second pixels corresponding to the first pixels. The first proportion has a mapping relationship with the decreasing amount. The display panel can determine the decreasing amount according to the first proportion. The larger the first proportion, the larger the preset refresh rate after be decreased, that is, the first proportion has a positive correlation relationship with the target refresh rate. Of course, the display panel can also determine a number of first pixels whose pixel values is same as those of second pixels corresponding to the first pixels, thus to obtain a second proportion. The second proportion has a mapping relationship with the decreasing amount, thereby decreasing the preset refresh rate according to the second proportion to obtain the target refresh rate, the larger the second proportion, the smaller the target refresh rate.

Similarly, when the current display picture is a dynamic picture, the display panel can obtain a corresponding increasing amount according to the above principle, the larger a third proportion corresponding to a number of first pixels whose pixel values being different from those of second pixels corresponding to the first pixels from the total number of the pixels of the current display picture, the larger the target refresh rate. The larger a fourth proportion corresponding to a number of first pixels whose pixel values being same to those of second pixels corresponding to the first pixels from the total number of the pixels of the current display picture, the smaller the target refresh rate.

The disclosure also provides a display panel including a memory and at least one processor, the memory stores computer-executable instructions executable by the at least one processor, the computer-executable instructions is executed by the at least one processor to cause the at least one processor to perform the following operations:

determining gray scale values of pixels to be displayed of the current display picture and a picture type of the current display picture;

determining a target refresh rate according to the picture type; and determining a target gray scale correction value according to the target refresh rate, and determining target gray scale values according to the target gray scale correction value and the gray scale values, the target refresh rate and the target gray scale correction value being negatively correlated.

The disclosure also provides a computer-readable storage medium storing computer-executable instructions executable by at least one processor, when the computer-executable instructions are executed by the at least one processor, the at least one processor is caused to perform the following operations:

determining gray scale values of pixels to be displayed of the current display picture and a picture type of the current display picture;

determining a target refresh rate according to the picture type; and determining a target gray scale correction value according to the target refresh rate, and determining target gray scale values according to the target gray scale correction value and the gray scale values, the target refresh rate and the target gray scale correction value being negatively correlated.

The above-mentioned serial numbers of embodiments of the present disclosure are for illustration only and do not represent the advantages or disadvantages of the embodiments.

It should be noted that, in this document, the terms "include", "comprise" or any other variation thereof are intended to encompass non-exclusive inclusion such that a process, method, article, or device that includes a series of elements includes not only those elements, but also other elements that are not explicitly listed, or also elements inherent to such a process, method, article, or device. Without further restrictions, an element defined by the statement "including a . . . " does not exclude the existence of other identical elements in the process, method, article or device that includes the element.

From the above description of embodiments, it will be apparent to those skilled in the art that methods of the above embodiments can be implemented by means of software plus a necessary universal hardware platform, of course they may also be implemented by means of hardware, but in many cases the former is an optional embodiment. Based on such an understanding, the technical schemes of the disclosure in essence or the part that contributes to the related art can be embodied in the form of software products. The computer software product is stored in a storage medium (e.g., a ROM/RAM, a disk, an optical disk) as described above and includes several instructions to cause a terminal device (which may be a mobile phone, a computer, a server, a television, a network device, etc.) to perform the methods described in various embodiments of the present disclosure.

The above are only alternative embodiments of the disclosure and they are not thereby limiting the scope of the patent of the disclosure. Any equivalent structure change or equivalent flow change made by utilizing the contents of the specification and the accompanying drawings of the disclosure, or any direct or indirect application to other related technical fields, is likewise included in the claimed scope of the disclosure.

What is claimed is:

1. A method for determining gray scale values of pixels, comprising the following operations:

determining gray scale values of pixels to be displayed of a current display picture and a picture type of the current display picture;

determining a target refresh rate according to the picture type; and determining a target gray scale correction value according to the target refresh rate, and determining target gray scale values according to the target gray scale correction value and the gray scale values, the target refresh rate and the target gray scale correction value being negatively correlated.

2. The method according to claim 1, wherein the operation of determining a target gray scale correction value according to the target refresh rate comprises:

determining a gray scale correction value of the pixels to be displayed, and determining a compensation parameter according to the target refresh rate; and correcting the gray scale correction value according to the compensation parameter to obtain the target gray scale correction value.

3. The method according to claim 2, wherein the operation of determining a gray scale correction value of the pixels to be displayed comprises:

determining corresponding display positions of the pixels to be displayed on the display panel; and determining the gray scale correction value of the pixels to be displayed according to the display positions.

4. The method according to claim 3, wherein the operation of determining a gray scale correction value of the pixels to be displayed according to the display positions comprises:

determining a lookup table about display positions and gray scale correction values;

determining the gray scale correction value corresponding to the display positions in the lookup table.

5. The method according to claim 1, wherein, after the operation of determining gray scale values of pixels to be displayed of a current display picture, the method further comprises:

determining display positions of the pixels to be displayed on the display panel;

in responding to that the display positions are in a color uneven area of the display panel, performing the operation of determining a picture type of the current display picture;

in responding to that the display positions are not in the color uneven area of the display panel, taking the gray scale values as the target gray scale values.

6. The method according to claim 1, wherein the picture type comprises a dynamic picture and a static picture, the operation of determining a target refresh rate according to the picture type comprises:

obtaining a preset refresh rate;

in responding to that the current display picture is a dynamic picture according to the picture type, increasing the preset refresh rate to obtain the target refresh rate, wherein an increasing amount of the preset refresh rate is determined according to the number of pixels of the current display picture that are different from corresponding pixels of a previous display picture frame; and in responding to that the current display picture is a static picture according to the picture type, decreasing the preset refresh rate to obtain the target refresh rate, wherein a decreasing amount of the preset refresh rate is determined according to a number of pixels of the current display picture that are different from the corresponding pixels of the previous display picture frame.

7. The method according to claim 6, wherein the operation of determining a picture type of the current display picture comprises:

obtaining the previous display picture frame;

determining a second pixel of the previous display picture frame corresponding to a first pixel of the current display picture, and comparing a pixel value of the first pixel with a pixel value of the second pixel;

determining that the current display picture is the static picture when a number of first pixels whose pixel values are the same as pixel values of corresponding second pixels is greater than a first preset number; and determining that the current display picture is the dynamic picture when a number of first pixels whose pixel values are different from pixel values of corresponding second pixels is greater than a second preset number.

8. The method according to claim 1, wherein the operation of determining a target gray scale correction value according to the target refresh rate and determining target gray scale values according to the target gray scale correction value and the gray scale values, the method further comprises:

determining a display time point of a next display picture frame according to the target refresh rate after all pixels to be displayed of the current display picture are displayed on the display panel according to their corresponding target gray scale values;

in responding to that the display time point arrives, taking the next display picture frame as the current display picture, and repeat to perform the operation of determining gray scale values of pixels to be displayed of the current display picture and a picture type of the current display picture.

9. A display panel comprising a memory and at least one processor, the memory storing non-transitory computer-executable instructions executable by the at least one processor, wherein when the non-transitory computer-executable instructions are executed by the at least one processor, the at least one processor is caused to perform the following operations:

determining gray scale values of pixels to be displayed of a current display picture and a picture type of the current display picture;

determining a target refresh rate according to the picture type; and determining a target gray scale correction value according to the target refresh rate, and determining target gray scale values according to the target gray scale correction value and the gray scale values, the target refresh rate and the target gray scale correction value being negatively correlated.

10. The display panel according to claim 9, wherein the operation of determining a target gray scale correction value according to the target refresh rate comprises:

determining a gray scale correction value of the pixels to be displayed, and determining a compensation parameter according to the target refresh rate; and correcting the gray scale correction value according to the compensation parameter to obtain the target gray scale correction value.

11. The display panel according to claim 10, wherein the operation of determining a gray scale correction value of the pixels to be displayed comprises:

determining corresponding display positions of the pixels to be displayed on the display panel; and determining the gray scale correction value of the pixels to be displayed according to the display positions.

12. The display panel according to claim 11, wherein the operation of determining a gray scale correction value of the pixels to be displayed according to the display position comprises:

determining a lookup table about display positions and gray scale correction values;

determining the gray scale correction value corresponding to the display positions in the lookup table.

13. The display panel according to claim 9, wherein, after the operation of determining gray scale values of pixels to be displayed of the current display picture, when the computer-executable instructions are executed by the at least one processor, the at least one processor are further caused to perform the following operations:

determining display positions of the pixels to be displayed on the display panel;

in responding to that the display positions are in a color uneven area of the display panel, performing the operation of determining a picture type of the current display picture;

in responding to that the display positions are not in the color uneven area of the display panel, taking the gray scale values as the target gray scale values.

14. The display panel according to claim 9, wherein the picture type comprises a dynamic picture and a static picture, the operation of determining a target refresh rate according to the picture type comprises:

obtaining a preset refresh rate;

in responding to that the current display picture is a dynamic picture according to the picture type, increasing the preset refresh rate to obtain the target refresh rate, wherein an increasing amount of the preset refresh rate is determined according to the number of pixels of the current display picture that are different from corresponding pixels of a previous display picture frame; and in responding to that the current display picture is a static picture according to the picture type, decreasing the preset refresh rate to obtain the target refresh rate, wherein a decreasing amount of the preset refresh rate is determined according to a number of pixels of the current display picture that are different from the corresponding pixels of the previous display picture frame.

15. A non-transitory computer-readable storage medium storing non-transitory computer-executable instructions executable by at least one processor, wherein when the non-transitory computer-executable instructions are executed by the at least one processor, the at least one processor is further caused to perform the following operations:

determining gray scale values of pixels to be displayed of a current display picture and a picture type of the current display picture;

determining a target refresh rate according to the picture type; and determining a target gray scale correction value according to the target refresh rate, and determining target gray scale values according to the target gray scale correction value and the gray scale values, the target refresh rate and the target gray scale correction value being negatively correlated.

16. The non-transitory computer-readable storage medium according to claim 15, wherein the operation of determining a target gray scale correction value according to the target refresh rate comprises:

determining a gray scale correction value of the pixels to be displayed, and determining a compensation parameter according to the target refresh rate; and correcting the gray scale correction value according to the compensation parameter to obtain the target gray scale correction value.

17. The non-transitory computer-readable storage medium according to claim 16, wherein the operation of determining a gray scale correction value of the pixels to be displayed comprises:

determining corresponding display positions of the pixels to be displayed on the display panel; and determining the gray scale correction value of the pixels to be displayed according to the display positions.

18. The non-transitory computer-readable storage medium according to claim 17, wherein the operation of determining a gray scale correction value of the pixels to be displayed according to the display position comprises:

determining a lookup table about display positions and gray scale correction values;

determining the gray scale correction value corresponding to the display positions in the lookup table.

19. The non-transitory computer-readable storage medium according to claim 15, wherein, after the operation of determining gray scale values of pixels to be displayed of the current display picture, when the non-transitory computer-executable instructions are executed by the at least one processor, the at least one processor is further caused to perform the following operations:

determining display positions of the pixels to be displayed on the display panel;

in responding to that the display positions are in a color uneven area of the display panel, performing the operation of determining a picture type of the current display picture;

in responding to that the display positions are not in the color uneven area of the display panel, taking the gray scale values as the target gray scale values.

20. The non-transitory computer-readable storage medium according to claim 15, wherein the picture type comprises a dynamic picture and a static picture, the operation of determining a target refresh rate according to the picture type comprises:

obtaining a preset refresh rate;

in responding to that the current display picture is a dynamic picture according to the picture type, increasing the preset refresh rate to obtain the target refresh rate, wherein an increasing amount of the preset refresh rate is determined according to the number of pixels of the current display picture that are different from corresponding pixels of a previous display picture frame; and in responding to that the current display picture is a static picture according to the picture type, decreasing the preset refresh rate to obtain the target refresh rate, wherein a decreasing amount of the preset refresh rate is determined according to a number of pixels of the current display picture that are different from the corresponding pixels of the previous display picture frame.

* * * * *